United States Patent [19]

Greene

[11] Patent Number: 4,990,898

[45] Date of Patent: Feb. 5, 1991

[54] SURFACE-MOUNT INTRUSION DETECTION SWITCH HOUSING

[76] Inventor: Teddy R. Greene, 2171 Research Dr., Livermore, Calif. 94550

[21] Appl. No.: 446,033

[22] Filed: Dec. 5, 1989

Related U.S. Application Data

[63] Continuation-in-part of Ser. No. 277,162, Nov. 29, 1988, Pat. No. 4,903,010.

[51] Int. Cl.[5] ..... G08B 23/00

[52] U.S. Cl. ..... 340/693; 200/61.7; 335/205

[58] Field of Search ..... 340/693; 200/61.7; 335/205

[56] References Cited

U.S. PATENT DOCUMENTS 4,148,001 4/1979 Gwozdz ..... 200/61.7

4,700,163 10/1987 Wolfe, Jr. ..... 200/61.7

*Primary Examiner*—Joseph A. Orsino

*Assistant Examiner*—Kinfe-Michael Negash

*Attorney, Agent, or Firm*—Townsend and Townsend

[57] ABSTRACT

A housing for a surface-mount magnet and magnetically sensitive switch unit pair for use in an intrusion detection device. The switch and magnet units include a generally cylindrical housing member formed with a hollow interior cavity, which contains the switch or magnet. The exterior surface of the housing member is threaded and has an end cap formed to receive a screw driver. The units are installed by screwing the housing member directly into the supporting structure. The housing member of the switch unit is further formed with a laterally projecting positioning surface for postioning the switch unit against a surface of the door or window assembly and determining the depth to which the unit is inserted. The end portion or cap of the housing member is formed to provide a passageway from the interior cavity of the housing member to the exterior of the end cap, and a pair of wires from the switch pass through the passageway and emerges from the end cap at a position to be mounted on the surface of the door or window assembly when the switch unit is in its mounted configuration. In a corresponding magnet unit the magnet may protrude into the end cap beyond the positioning surface so that it is offset from the position of the switch in the corresponding switch unit. A pair with such an offset may be used to compensate, at least partially, for mounting on uneven surfaces.

5 Claims, 1 Drawing Sheet

SURFACE-MOUNT INTRUSION DETECTION SWITCH HOUSING

CROSS-REFERENCE TO RELATED APPLICATIONS

This is a continuation in part of patent application Ser. No. 07/277,162, filed Nov. 29, 1988, now U.S. Pat. No. 4,903,010, issued Feb. 20, 1990 the disclosure of which is incorporated herein by reference.

BACKGROUND OF THE INVENTION

The present invention relates to intrusion detectors for door or window assemblies or the like, and is more particularly directed to an easily installable magnetic switch assembly.

Intrusion detectors for home security are used to sound an alarm or provide other warning signals when a window or door or the like is opened. One common type of intrusion detector is a magnetic switch assembly having two separate constituent pieces. One piece provides a magnetically sensitive switch, such as a reed switch, and the other piece provides a magnet. The magnet is mounted in an edge of the door or window to be protected, and the reed switch is mounted opposite the magnet in the adjacent frame or casing of the door or window. The reed switch is electrically connected by wires or appropriate cabling routed through the walls to control circuitry for the alarm system. When the intrusion detection system is activated and the window or door is opened, movement of the magnet away from the reed switch trips the switch and energizes the alarm.

In known intrusion detectors of this type, the reed switch and the magnet are each typically encapsulated in a generally cylindrical, and sometimes tapered, plastic casing. Each piece is installed by inserting it into a hole pre-drilled in the door or frame, setting the right depth, then sealing it in position, and spackling and painting over it so as to be unnoticeable. Such installation in the past has proven to be cumbersome and labor intensive.

Although it is preferred to hide the cabling for the reed switch by routing it through the walls, in some circumstances it is not possible, or it may be too costly, to do so. In such cases the wires are routed on the surface of the wall generally along the edges at molding strips or at the floor. Reed switches intended to be cabled in this manner are generally referred to as surface-mount reed switches because they may be connected to surface-mounted wires. Known surface-mount reed switches generally have exposed terminals, to which the surface-mounted cabling may be connected once the switch is mounted in the jamb side of the door or window assembly. These terminals or contacts present a security risk because, if left exposed, they may be shorted out to defeat the system, and to cover or disguise the contacts requires additional labor and cost.

SUMMARY OF THE INVENTION

The present invention provides a surface-mount switch unit for use in the above-described type of intrusion detection device, which is substantially easier and quicker to install than previously known constructions and which eliminates the exposed contacts for connection to the surface-mounted cabling. Briefly, a switch unit according to the invention includes a generally cylindrical housing member formed with a hollow interior cavity, which contains the switch. As in my copending application Ser. No. 07/277,162, the exterior surface of the housing member is threaded and has an end cap formed with a slot, Philips head, or the like to receive a screw driver. The unit is installed simply by screwing the housing member directly into the supporting structure. Here the housing member is further formed with a laterally projecting positioning surface for positioning the switch unit against a surface of the door or window assembly so that the unit may be screwed into the door or window assembly to a depth determined by the positioning surface. The threaded surface of the housing member extends to one side of the positioning surface and to the other side of the positioning surface the housing member forms a protruding end cap. The end cap in turn is formed to provide a passageway from the interior cavity of the housing member to the exterior of the end cap, and a pair of wires from the switch pass through the passageway and emerge from the end cap at a position to be mounted on the surface of the door or window assembly when the switch unit is in its mounted configuration.

The invention also provides a magnet unit for use with the above-described switch unit which enables the pair to be mounted in a door or window assembly which is configured such that the units are each mounted on surfaces at different levels offset from one another by a predetermined amount. The magnet unit comprises a hollow housing member formed with a threaded exterior surface and end cap for receiving a screw driver the same as the corresponding switch unit, and the magnet is mounted within the hollow housing member. As in the switch unit, the magnet unit also has a positioning surface for positioning the unit at a predetermined depth within the door or window. The end cap of the magnet unit defines an internal cavity and the magnet extends into that cavity beyond the level of the positioning surface a distance approximately equal to the predetermined offset of the surfaces on which the magnet and switch units are mounted. The extension of the magnet into the end cap compensates for the offset when the magnet and switch are in their mounted configuration.

Other features and advantages of the invention are described hereinbelow or will be apparent from the following specifications and appended drawings.

DETAILED DESCRIPTION OF THE PREFERRED EMBODIMENTS

Figure 1:
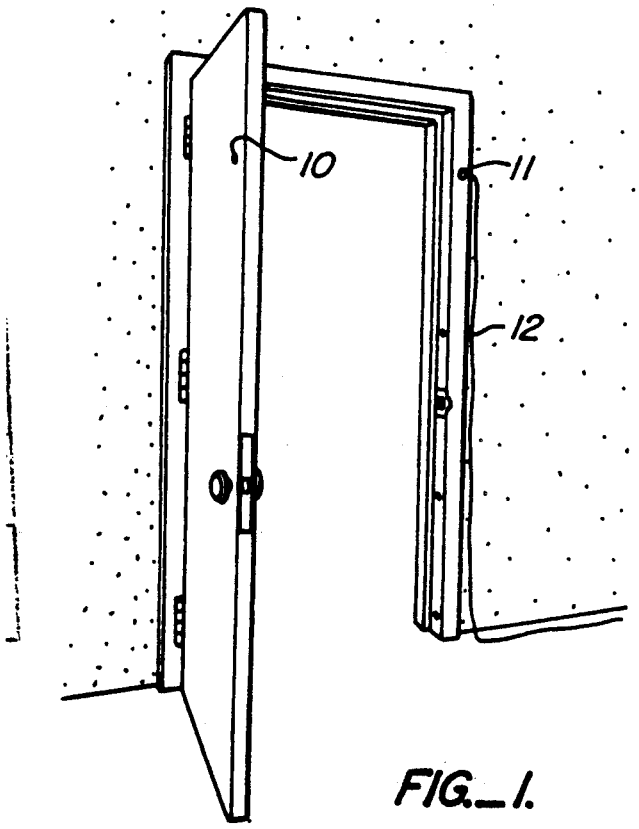
FIG. 1 shows a door assembly with a pair of magnetic switch units installed.

FIG. 1 shows a door assembly, in which an intrusion detection device as in the present invention has been installed. Although illustrated here in a door assembly, it is of course understood that the invention is not limited to use with doors, but may be applied in other types of entry ways or other configurations. A first switch unit 10 is installed in the door mounted flush on the surface, and a second switch unit 11 is installed in the door frame at a position opposite the first unit 10. The door unit 10 is a self-contained unit including a magnet. The frame unit 11 includes a magnetically sensitive switch generally connected by wires 12 routed on the surface of the wall to a control mechanism (not shown). When the door is closed, the frame unit 11 lies within the magnetic influence of the door unit 10. When the door is opened, that magnetic influence is removed and the frame unit 11 is activated.

Figure 2:
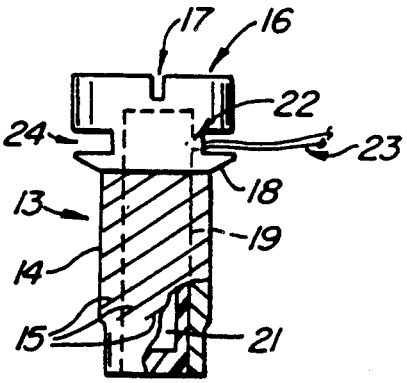
FIG. 2 is an elevational view, partially cut away, showing an embodiment of a switch unit according to the invention.

As shown in FIG. 2, a switch unit according to the invention includes a generally cylindrical housing member 13 which is formed with a threaded exterior wall 14. Although illustrated here in a truly cylindrical geometry, the housing member may be tapered without departing from the broad scope of the invention. Unlike a typical screw, which is formed with a single spiral thread, the embodiment of FIG. 2 includes a plurality of spiral threads 15, which are evenly disposed about the circumference of the housing member 13. The plurality of threads provides for firm and even gripping of the door or door frame as the unit is screwed in.

The end portion or cap 16 of the cylindrical member 13 is formed to receive a screw driver. As illustrated in FIG. 2, the end portion 16 defines a slot 17 to receive the flat blade of a conventional screw driver. The end portion, however, may also be formed to receive a Phillips head or other type of screw driver. The housing member is further formed with a laterally projecting positioning surface 18 for positioning the switch unit against a surface of the door or window assembly so that the unit may be screwed into the door or window assembly to a depth determined by the positioning surface. That is, the positioning surface provides a stop for locating the unit so that it may be installed at a controlled depth. In the embodiment of FIG. 2 the positioning surface is defined by the lower surface of the end cap 16.

The same housing may be used with both the magnet and with the magnetically sensitive switch. When it is not necessary to distinguish between magnet or switch, these are referred to generically herein as operative detection elements. The cylindrical housing member 13 is hollow so as to define an interior cavity 19. The operative detection element 21 is contained within the cavity and fixed in position by appropriate means well known to those skilled in the art. Such means include back-filling the cavity with plastic resins, such as ABS or epoxy, or encapsulating the element in a plastic jacket or capsule and swedging in place. The element may also be held in place by crimping or otherwise closing the end of the housing. FIG. 2 includes a partially cutaway portion revealing a switch element so mounted within the housing.

As shown in FIG. 2, the interior cavity 19 extends into the end cap 16. When the housing member houses a magnet, under certain conditions described more fully below it may be desirable for the magnet to protrude into that portion of the cavity in the end cap cavity. When the housing member houses a switch, the cavity in the end cap provides room to route the switch wires from the switch to the exterior of the end cap. The end cap 16 is formed with a passageway, indicated at reference numeral 22, running from the interior cavity of the housing member to the exterior of the end cap. A pair of wires 23 from the switch pass through the passageway and emerge from the end cap at a position to be mounted on the surface of the door or window assembly when the switch unit is in its mounted configuration. The end cap may also be formed with a groove 24 in the side wall of the end cap through which the wires 23 exit the end cap. The groove serves to locate the wires at the surface on which the wires are to be mounted. If the wires are to be routed along the wall in a different angular direction from which they exit the end cap, they may be tucked into the groove and directed around the end cap to the desired angle.

It is occasionally necessary to mount the switch side and the magnet side of a pair of units on surfaces which are at different levels with respect to one another. For example, a door frame may have a molding around it providing a surface which is offset from the door surface by a predetermined amount. This offset may be compensated for in the present invention by extending the interior cavity 19 into the end cap and positioning the magnet in that cavity beyond the level of the positioning surface 18 a distance approximately equal to the predetermined offset of the surfaces on which the magnet and switch units are mounted.

Figure 3:
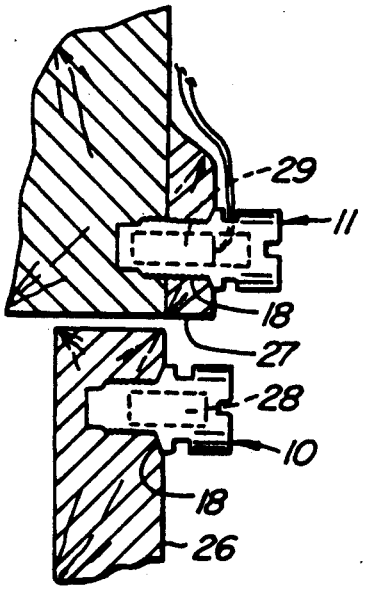
FIG. 3 is an elevational view, partially in section, of a magnet and switch unit pair mounted on uneven surfaces.

FIG. 3 shows a magnet and switch unit pair in their approximate relative disposition in their installed configuration on uneven surfaces. The magnet unit 10 is mounted in the door 26 with the positioning surface 18 flush with the surface of the door. The corresponding switch unit 11 is mounted in a molding strip 27 offset from the level of the door surface. The magnet 28 in the unit 10 extends beyond the level of the positioning surface 18 above the level of the door and into the end cap by an amount approximately equal to the offset defined by the molding 27. The switch 29 in the switch unit 11, on the other hand, does not protrude beyond the positioning surface 18, although the interior cavity 19 may extend into the end cap. In this manner switch units and magnet units may be paired to provide a measure of compensation for uneven mounting surfaces.

While the above provides a full disclosure of illustrative embodiments of the invention, various modifications, alternate constructions, and equivalents may be employed without departing from the spirit and scope of the invention. For example, those skilled in the art will recognize that although illustrated here as mounted in parallel configuration, a magnet and switch unit pair may also be mounted perpendicular to one another or end to end to accomodate various geometries of door and window assemblies. The benefits of the invention will also be enjoyed in these alternative configurations. Therefore, the invention is not to be limited to the above illustrative embodiments, but is defined by the appended claims.

What is claimed is:

1. A switch unit for use in an intrusion detection system for mounting in a door or window assembly, said switch unit having switch wires for connection to said intrusion detection system, comprising:

a generally cylindrical hollow housing member formed with a threaded exterior wall and having an end cap formed to received a screw driver for screwing said generally cylindrical hollow housing member directly into said door or window assembly;

a switch fixed within said generally cylindrical hollow housing member for detecting movement of said door or window assembly;

wherein said end cap is further formed with a laterally projecting positioning member for positioning said switch unit against a surface of said door or window assembly, whereby said switch unit is adapted to be threadably installed in said door or window assembly to a depth determined by said laterally projecting positioning member; and wherein said end cap is formed to define a passageway from said generally cylindrically hollow housing member to the exterior of said end cap and said switch wires pass through said passageway, whereby said switch wires are positioned to be mounted on the surface of said door or window assembly when said switch unit is mounted therein.

2. The switch unit of claim 1 wherein said passageway and said switch wires exit said end cap at a sidewall thereof.

3. The switch unit of claim 1 wherein said end cap is formed with a circumferential groove proximate to said laterally projecting positioning member and said passageway and said switch wires exit said end cap in said groove.

4. A magnet unit for use with a corresponding switch unit in an intrusion detection system for mounting in a door or window assembly, comprising:

a generally cylindrical housing member having an interior cavity and formed with a threaded exterior wall and having an end cap formed to receive a screw driver for screwing said housing member directly into said door window assembly;

a magnet fixed within said interior cavity of said generally cylindrical housing member for detecting movement of said door or window assembly;

wherein said end cap is further formed with a laterally extending positioning member for positioning said magnet unit against a surface of said door or window assembly, whereby said magnet unit is adapted to be threadably installed in said door or window assembly to a depth determined by said laterally extending positioning member; and wherein said end cap is formed to define an internal cavity and said magnet extends therein beyond said laterally extending positioning member a predetermined distance, whereby in mounted configuration said magnet is displaced above the surface on which it is mounted so as to compensate for an offset between said magnet unit and said corresponding switch unit when said magnet unit and switch unit are mounted on surfaces at different levels from on another.

5. A magnet unit and switch unit pair for use in an intrusion detection system for mounting in a door or window assembly which is configured such that said magnet unit and switch unit are to be mounted on surfaces at different levels offset from one another by a predetermined offset, said switch unit having switch wires for connection to said intrusion detection system, wherein said magnet unit and switch unit pair is characterized in that each said unit comprises:

a generally cylindrical housing member having an interior cavity and formed with a threaded exterior wall and having an end cap formed to receive a screw driver for screwing said generally cylindrical housing member directly into said door or window assembly; and a repsective magnet or magnetically responsive switch fixed within and interior cavity of said generally cylindrical housing member for detecting movement of said door or window assembly;

wherein said end cap is further formed with a laterally extending positioning member for positioning the respective unit against a surface of said door or window assembly, whereby the respective unit is adapted to be threadably installed in said door or window assembly to a depth determined by said laterally extending positioning member;

wherein said switch unit is further characterized in that the end cap thereof is formed to define a passageway from said interior cavity of said generally cylindrical housing member to the exterior of said end cap and said switch wires pass through said passageway, whereby said switch wires may be mounted on the surface of said door or window assembly when said switch unit is mounted therein; and wherein said magnet unit is further characterized in that the end cap thereof defines an internal cavity and said magnet extends therein a distance approximately equal to said predetermined offset so as to compensate for said offset when said magnet unit and said switch unit are in their mounted configuration.

* * * * *